US011054115B2

(12) United States Patent
Cadisch et al.

(10) Patent No.: US 11,054,115 B2
(45) Date of Patent: Jul. 6, 2021

(54) SPOTLIGHT COUPLING MECHANISM

(71) Applicants: Simon Cadisch, Hertfordshire (GB); Ecoled Ltd, Hertfordshire (GB)

(72) Inventors: Simon Cadisch, Hertfordshire (GB); David Ong, London (GB)

(73) Assignee: ECOLED LTD., Hatfield (GB)

( * ) Notice: Subject to any disclaimer, the term of this patent is extended or adjusted under 35 U.S.C. 154(b) by 0 days.

(21) Appl. No.: 16/460,193

(22) Filed: Jul. 2, 2019

(65) Prior Publication Data

US 2020/0003398 A1 Jan. 2, 2020

(30) Foreign Application Priority Data

Jul. 2, 2018 (GB) ..... 1810860

(51) Int. Cl.
*F21V 14/06* (2006.01)

(52) U.S. Cl.
CPC ..... *F21V 14/06* (2013.01)

(58) Field of Classification Search
CPC ..... F21V 29/83; F21V 21/30; F21V 29/763; F21V 21/096; F21V 21/03; F21Y 2115/10
See application file for complete search history.

(56) References Cited

U.S. PATENT DOCUMENTS 8,172,436 B2 * 5/2012 Coleman ..... F21V 21/096 362/249.02
9,222,653 B2 * 12/2015 Holland ..... F21V 21/096
2014/0268722 A1 * 9/2014 Holland ..... F21V 29/85 362/218

FOREIGN PATENT DOCUMENTS

KR 2014087939 A * 2/2014

OTHER PUBLICATIONS

KR-2014087939-A, machine translation (Year: 2014).*

* cited by examiner

*Primary Examiner* — Tracie Y Green
(74) *Attorney, Agent, or Firm* — Blue Filament Law PLLC

(57) ABSTRACT

A coupling mechanism for a lighting apparatus (and a lighting apparatus having a housing, a mount and the coupling mechanism for coupling the lighting apparatus to the housing) has a first coupling member comprising a curved strip and a second coupling member comprising a retaining element for magnet coupling with the curved strip at multiple positions along its length whereby the first coupling member may be adjustably orientated about at least one axis relative to the second coupling member. The lighting system having the coupling mechanism is thus a multi-direction lighting system which may be directed over a wide illumination area and which is simple and easy to assemble and adjust.

24 Claims, 4 Drawing Sheets

SPOTLIGHT COUPLING MECHANISM

FIELD OF THE INVENTION

This invention relates to the field of spotlight illumination. More particularly, it relates to a lightweight lighting assembly having easy adjustment over a wide angle of illumination, a system incorporating such an assembly and to a method of installing and manufacturing.

BACKGROUND OF THE INVENTION

Lighting systems for directed illumination often incorporate an adjustment means to enable changes to the illumination direction as desired by the user making illumination changes and the installer fitting the light system for the first time. Some light system fittings additionally allow partially removable spotlights for simple light unit replacement. As lighting technology has advanced in recent years from filament to halogen to fluorescent and more recently to light emitting diode there has been a considerable reduction in the electrical power consumption required for similar light outputs. The change in power requirement has led to different requirements from the housing units incorporating each lighting technology and has tended to enable the use of different materials previously considered unsuitable because of the inability to conduct or withstand heat from the light unit or associated electronics.

In addition to an illumination adjustment requirement for fixing and adjustment of the lighting units, lighting systems incorporating such units must therefore also primarily meet technical criteria dependent on the lighting technology and these considerations often result in designs that have considerable visual impact on their surroundings. A further need relates to the requirement to have a lighting system that is simple and easy to install as well as a requirement for reduced visual impact.

There is a need therefore for a lighting system which is easily adjusted over a wide degree of illumination angle which is of simple aesthetic shape and easy to assemble.

The present inventor has devised a lightweight spotlight system easily assembled and easily adjusted over a wide angle of illumination direction.

Problem to be Solved by the Invention

There is a need for a lighting system which is easily adjusted over a wide degree of illumination angle which is simple and easy to assemble.

It is an object of this invention to provide a lighting system and lighting assembly which is easily adjusted over a wide degree of illumination angle and is easy to assemble.

SUMMARY OF THE INVENTION

In accordance with a first aspect of the invention, there is provided a coupling mechanism for a lighting apparatus, the coupling mechanism comprising: a first coupling member comprising a curved strip; and a second coupling member comprising a retaining element for coupling with the curved strip; wherein the second coupling member may couple with the first coupling member at multiple positions along a length of the curved strip and wherein the first and second coupling members are configured for magnetic coupling, whereby the first coupling member and the second coupling member may be adjustably orientated relative to one another about at least one axis.

In a second aspect of the invention, there is provided a lighting apparatus comprising: a housing for housing a light source and/or directing a beam of light from a light source; a lighting mount for securing the lighting apparatus to support or substrate; and a coupling mechanism comprising: a first coupling member comprising a curved strip; and a second coupling member comprising a retaining element for coupling with the curved strip; wherein the second coupling member may couple with the first coupling member at multiple positions along a length of the curved strip and wherein the first and second coupling members are configured for magnetic coupling, whereby the first coupling member and the second coupling member may be adjustably orientated relative to one another about at least one axis.

In a third aspect of the invention, there is provided a lighting apparatus comprising a housing for housing a light source and/or directing a beam of light from a light source, a lighting mount for securing the lighting apparatus to a support or substrate and a coupling mechanism for coupling the housing to the lighting mount.

In a fourth aspect of the invention, there is provided a housing for a lighting apparatus as defined in the above aspects.

In a fifth aspect of the invention, there is provided a method of manufacturing a lighting apparatus and coupling mechanism defined above.

In a sixth aspect of the invention, there is provided a method of installation of a lighting apparatus and coupling mechanism defined above.

In a seventh aspect, there is provided an apparatus for coupling a housing of a lighting apparatus to a mount, the apparatus comprising a coupling mechanism as defined above.

Advantages of the Invention

The lighting system of the present invention comprises a multi-direction lighting system which may be directed over a wide illumination area and which is simple and easy to assemble and adjust.

DETAILED DESCRIPTION OF THE INVENTION

Figure 1:
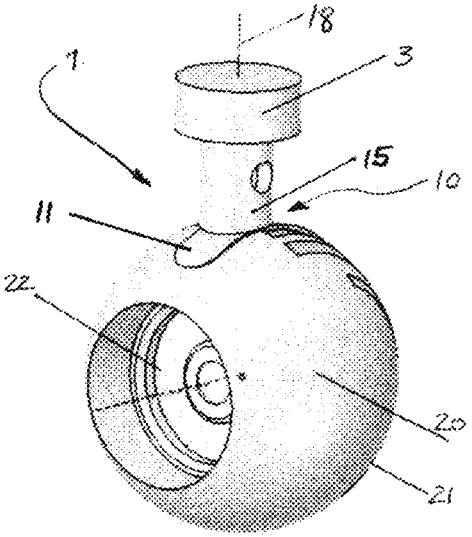
FIG. 1 is a perspective view of a an embodiment of a lighting apparatus of the invention in one configuration.

A lighting apparatus and a coupling mechanism for a lighting apparatus are described. The coupling mechanism and a lighting apparatus comprising the coupling mechanism may be configured for adjustment of the lighting apparatus to enable direction of illumination from the lighting apparatus, which is preferably a spotlight, to be adjusted over a wide angle. It is preferred that the lighting apparatus (or lighting assembly) is multi-directional whereby the angle of illumination from the lighting apparatus may be adjusted about more than one axis.

A coupling mechanism for use in a lighting apparatus according to one aspect of the invention has a first coupling member and a second coupling member for coupling with the first coupling member, which first and second coupling members may be adjustably orientated relative to one another about at least one axis and preferably about two axes. The first coupling member comprises a curved strip. The second coupling member comprises a retaining element for coupling with the curved strip at any of multiple positions along a length of the curved strep. The first and second coupling members are configured for magnetic coupling to one another, preferably at multiple locations along the length of the curved strips and preferably at any position along the length of the curved strip. The magnetic coupling between the first and second coupling members at multiple locations along the length of the curved strip may be derived from a series of (or multiple) discrete magnetic coupling arrangements or a continuous magnetic coupling arrangement.

Preferably, the retaining element may be capable of coupling with the curved strip at multiple discrete locations along the length of the curved strip. These multiple discrete locations may be any discrete locations on a continuum of possible discrete locations along the length of the curved strip or derived from a limited number of possible discrete locations owing to a limited number of discrete magnetic coupling arrangements.

Preferably, the retaining element and curved strip are configured for coupling at any potential location (continuously) along the length of the curved strip. Preferably, the retaining element may couple, at any one time, with the curved strip at any of multiple discrete locations along the curved strip. A discrete location may be any suitable size and may be defined by the relative sizes of the retaining element and the curved strip, but is preferably has a dimension no greater than five times the width of the curved strip, more preferably no greater than three times the width of the curved strip, e.g. from 0.5 to 2×the width of the curved strip.

The retaining element of the second coupling member and the curved strip of the first coupling member may couple, preferably magnetically, by facing coupling surfaces which, when the retaining element and curved strips are coupled, are those surfaces in contact or in closest facing arrangement to one another, since they may not be in direct contact as such (e.g. there may be a coating provided on the respective surfaces or an intervening buffer member, to reduce scratches or damage due to direct contact). A facing coupling surface of the retaining element may be any suitable shape and configuration. For example, it may be elongate and have a curve along its length (e.g. defining a concave facing coupling surface) or across its width (e.g. defining a convex facing coupling surface), it may be square or rectangular or other quadrangular or oval or triangular or circular or any other suitable shape. Optionally, the facing coupling surface may be convex (e.g. hemispherical) or concave. Optionally, it may be substantially planar. Optionally, the facing coupling surface of the retaining element and indeed the retaining element is ring-shaped, i.e. having an aperture therein e.g. to allow the passage of a power or data wire or cable from a housing of a lighting apparatus. Preferably, the facing coupling surface (and thus the retaining element) has an aperture (e.g. a circular aperture) therein for the passage of a data or power cable (e.g. an aperture of up to 10 mm, more preferably up to 5 mm or more preferably up to 3 mm and typically at least 1 mm, or at least 2 mm) and preferably the facing coupling surface is circular. The facing coupling surface may preferably be ring-shaped and preferably has a planar surface or a concave surface or part planar and part concave.

Optionally, the planar coupling surface of the retaining element is provided with a coating or a cover of resilient material, which may serve to reduce slippage as between the retaining element and curved strip and may serve to reduce contact damage. A cover may be a layer of resilient rubber or polymer foam material (e.g. of a thickness of up to 2 mm, preferably from 0.2 to 1 mm, more preferably up to 0.5 mm), whilst a coating may be a coating of a polymer material (e.g. up to 1 mm, such as from 0.05 to 0.5 mm, e.g. up to 0.2 mm).

Preferably, the retaining element has a coupling surface or facing coupling surface having a width or diameter of no more than five times the width of the curved strip, more preferably no more than three times the width and preferably in the range of half the width of the curved strip to two times the width of the curved strip and typically approximately equal to the width of the curved strip.

The retaining element may optionally be disposed in a recess of a retaining housing, which housing may be of any shape or size.

Preferably the facing coupling surface is a ring-shaped and thus defines an aperture therein and is preferably rotationally symmetrical about an axis perpendicular to the contact surface of the curved strip. Preferably, the retaining element comprises a metal or magnetic ring housed in a ring-shaped housing.

The second coupling member (or the coupling of the second coupling member to the first coupling member) is configured to provide rotational movement, e.g. for orientation about a second axis of, for example, a housing for lighting apparatus associated with the coupling mechanism. The rotational movement may be provided as between and facilitated by the coupling of the retaining element and the curved strip (in a preferred embodiment), i.e. rotation of the retaining element relative to the curved strip between the contact surfaces thereof, or may be provided by the second coupling member or retaining element elsewhere, dissociated from the coupling of the retaining element and the curved strip. This may be by a magnetic coupling, e.g. between a retaining element and a lighting mount of the second coupling member, or by non-magnetic coupling within the retaining element or between the retaining element and a lighting mount (e.g. ball and socket mounting, or bearing mount or simple rotational mount).

The curved strip of the first coupling member, as used herein, is an arrangement of material, in a strip, capable and configured to couple with the retaining element of a second coupling element. By this curved strip arrangement, the retaining element may couple with the curved strip at different positions along the length of the curved strip and thus be orientated at different respective angles to the curved strip (by virtue of the curve of the curved strip). Optionally, the strip may be configured within a body, continuous therewith or discretely formed and mounted within a body, such as a housing for a light fitting. The curved strip may an arrangement of elements or components which together form a strip or may be a discrete element formed of a discrete strip of material. For example, the curved strip may comprise a series of closely arranged elements, e.g. disc members, arranged in a strip, each of which or a combination of two or more of which may be effective in coupling with a retaining element and whereby the retaining element may be coupled with the arrangement of elements at multiple locations along the length of the strip arrangement. Preferably, however, a strip may comprises a discrete length of material which is capable of coupling with a retaining element at multiple locations, preferably continuously, along the length of the strip. The strip may comprise a single length or strip of material or may comprise two or more lengths or strips of material, typically in parallel. In a particularly preferred embodiment, the strip comprises two lengths or strips of material in parallel and defining therebetween a gap of suitable size to allow passage of a cable for data or power. Thus, the gap, according to this preferred embodiment, may be up to 10 mm in width, more preferably up to 5 mm or more preferably up to 3 mm and typically at least 1 mm, or at least 2 mm.

The strip may have an exposed coupling surface in which the material of the strip is entirely exposed for coupling contact with a retaining element or may have a coating or cover or may be embedded within the material of a housing of a light fitting, for example, whereby it is still capable of magnetic coupling with the retaining element but does not achieve direct contact therewith, other than via the coating or cover or material of the housing. The coating (e.g. of cured polymer) or cover (e.g. of rubber or polymer foam) or material of the housing (e.g. of thermoset plastic) covering the curved strip may be of any desire thickness as long as it does not disrupt the functioning, in coupling with the retaining element, of the curved strip, e.g. up to 5 mm thick, preferably up to 2 mm, optionally at least 0.05 mm or at least 0.1 mm, e.g. in the range 0.05 to 0.5 mm or more typically in the range 0.2 to 1 mm, more preferably up to 0.5 mm.

A curved strip has a length that is greater than its width. The depth or thickness of the curved strip is of no particular consequence unless it is relied upon for a property of the material of the curved strip, e.g. as a magnet, in which case it must be of sufficient depth or thickness to impart the desired property to the desired extent. The curved strip thus may be a thin layer of material (or arrangement of thinly layered elements arranged in a strip), e.g. from 0.5 to 2 mm thick or may be thicker, e.g. from 5 mm to 10 mm thick, or may be therebetween (e.g. from 2 to 5 mm). The curved strip may alternatively be provided by an edge of a larger component (e.g. disposed within a housing of a light fitting) or a plurality of protruding elements from one or more larger components, the protruding elements having outer surfaces (which themselves need not be curved) arranged to together form a curved strip. In one embodiment, the strip is defined by a planar edge or two parallel planar edges from a larger component, e.g. comprising two plate members having edges for together forming a curved strip.

Preferably, the curved strip comprises a discrete length of material or two, preferably parallel, elongate elements or lengths of material, which may be formed by the edge of a larger component (e.g. disposed within a housing of a light fitting). The two lengths of material or elongate elements may be described as rails. Preferably, they are separated by a recess (e.g. for providing passage of a wire or cable).

In one preferred embodiment, the first coupling member comprising the curved strip comprises one or a plurality (e.g. two) of plate members each having an edge (a plate edge) which one or more plate edges defined the curved strip.

The curved strip may be formed of any suitable material for coupling with the retaining element. Preferably for magnetic coupling, the curved strip is or contains a magnet or a ferromagnetic material. For example, the curved strip may comprise a polymer having a high proportion of iron powder or filings as filler (e.g. greater than 60%). Optionally, the curved strip is a strip of magnet or magnetic material. Preferably, the curved strip is an iron-containing material, e.g. an iron containing alloy, such as mild steel, which is the preferred material for the curved strip.

The curved strip may be a strip that defines a curve or part of which defines a curve. Or the curved strip may comprise more than one curve. In any case, the curved strip comprises a length defining a curve whereby positioning of a retaining element at different locations along the that length of the curve cause the retaining element to be oriented at a different angle to the curved strip as a whole and to any housing or substrate that the curved strip is attached to or associated with. Preferably, the curved strip is a strip that is curved along the entirety of its length.

The curved strip may define a longitudinal axis being an axis in a longitudinal plane of the curved strip. Preferably, the curved strip is curved along its length or, in other words, about an axis perpendicular or transverse to a longitudinal axis (or longitudinal plane) of the curved strip, the longitudinal axis or longitudinal plane being an axis or plane that is parallel with the length of the curved strip. Optionally, if the length of the curved strip follows a non-linear path (e.g. curves about an axis perpendicular to its contact surface), it may be said to define an average longitudinal axis (e.g. best fit longitudinal axis) or may have a longitudinal axis defined at any discrete position along its length.

In a preferred embodiment, the curved strip comprises a length that is straight, that is has no curves about a longitudinal axis perpendicular to the coupling surface of the curved strip.

Preferably the curved strip comprises a length that is flat across its width, that is has no or minimal curvature about its own longitudinal axis.

Preferably the curved strip is curved along its length, that is it defines a curve along its length (about an axis transverse to the longitudinal plane of the curved strip).

The curved strip may have a variable curvature or a constant curvature. The curved strip has a strip radius, which may be defined as a radius of curvature of the curved strip in the case of a strip of constant curvature or as an average (e.g. mean) radius of curvature of a curved strip of variable curvature (along a length of curved strip that is curved in the same orientation/direction).

Preferably, the curved strip has a length (or at least a length of a curved portion of the curved strip) that is at least 1× the strip radius (r), more preferably at least 1.5×r, e.g. at least 1.57×r, such as at least 1.6×r. By providing the curved strip at a length of at least 1.57×r, along which length a retaining element may be coupled with the curved strip, the coupling will allow rotation of a housing for a light apparatus mounted using the coupling of 180 degrees about one axis of orientation (that is, an axis transverse to a longitudinal plane of the curved strip) and where provided, as in a preferred embodiment, with a coupling or retaining element that facilitates rotation about a second axis (e.g. perpendicular to the contact surface of the curved strip), the coupling may further allow orientation about the second axis, e.g. of up 360 degrees. The curved strip may have a length of up to 6×r, more preferably up to 5×r and still more preferably up to 4.5×r. The curved strip may have a length of 2×r or 3×r or 4×r, for example in the range 2 to 3.5×r or 2.5 to 4×r. In any case, it is preferred that the length is in the range of 1.5 to 4.5×r and more preferably 2.5 to 3.5×r.

In combination with rotational movement, about an axis defined by the coupling surface between the curved strip and retaining element, provided by the coupling between the first and second coupling members or provided by the second coupling member or its mounting, the coupling mechanism provides for multi-directional orientation of an article mounted using the coupling mechanism, and in particular a spotlight, of, for example up to 270 degrees about a first axis of rotation and 360 degrees about a second axis of rotation, thus very simply, through a simple coupling providing very wide range of orientation for a light.

The curved strip may be of any suitable length according to the requirements and size of the coupling mechanism required. The width of the curved strip may be of any suitable width for the purpose required.

Preferably, the length is at least 2×the width, more preferably at least 3×the width, still more preferably at 4×the width, still more preferably at least 5×the width. The length may be for example up to 50×the width, but more typically up to 30×the width, and preferably up to 20×the width. Preferably, the length is from 7 to 15 times the width, e.g. 8 to 12×the width.

In one embodiment, for a domestic or commercial spotlight, e.g. roof or wall mounted, the curved strip may have a length of for example from 50 mm to 250 mm, preferably 100 to 200 mm, e.g. 120 to 150 mm, e.g. about 130 mm. The curved strip may, in one such embodiment, have a width of up to 30 mm, preferably up to 25 mm, at least 3 mm, e.g. at least 5 mm and preferably from 5 to 20, e.g. 7 to 15 mm and more preferably at least 10 mm. The radius of a curved strip in one such embodiment may be from 30 mm to 60 mm, preferably 35 to 50 mm, more preferably 40 to 45 mm.

In one preferred embodiment for a domestic or commercial lighting apparatus, the curved strip, which is preferably a strip of mild steel, has a length of from 125 to 140 mm, a width of from 8 to 15 mm and a radius of from 35 to 50 mm.

As is discussed above, in a coupling mechanism according to a preferred embodiment of the invention, the curved strip and the retaining element are configured to be adjustably orientated relative to one another about two axes. Preferably one (a first) of the two axes is an axis transverse to a longitudinal axis or longitudinal plane of the curved strip. Preferably, the retaining element comprises a facing coupling surface being that surface facing a coupling location on the curved strip when disposed in a coupled configuration with the curved strip and another (a second) of the two axes is perpendicular to the facing coupling surface of the retaining element.

In a coupling mechanism according to a preferred embodiment, one of the first coupling member (preferably the curved strip) and the second coupling member (preferably the retaining element) comprises a magnet while the other comprises a magnetic material. Preferably, the retaining element (of the second coupling element is a magnet) and the curved strip comprises (and preferably consists or consists essentially of) a ferromagnetic material, preferably mild steel.

The ferromagnetic strip and the magnetic retaining element of this preferred embodiment are selected to provide sufficient magnetic coupling strength to retain an article that it is used to couple, e.g. a housing for a light fitting under the conditions and environment in which the light unit is used. In some embodiments a non-magnetic insert may be fitted between the magnetic strip and the retaining element to provide friction or other characteristics to the magnetic coupling. In one embodiment the addition of a thin polymeric non-magnetic insert provides friction in the coupling which assists in retention of the coupled elements in a desired angular position.

Magnetic coupling between the first coupling member (such as a mild steel curved strip) and the second coupling member (such as the retaining element) typically comprises physically retaining them together or retained in close proximity by attraction of a magnetic field. Strength of magnetic field for this purpose is typically at least partially dependent on the nature of magnetic material used in the coupling member and the amount of the magnetic material (and the size of the component—curved strip or retaining element as the case may be). At least one of the coupling members comprises a magnet.

In a preferred embodiment of the invention and a preferred application of the coupling mechanism, the first coupling member is attached to or associated with or configured for attachment to one of a housing for a lighting apparatus and a lighting mount and the second coupling member is attached to or associated with or configured for attachment to the other of the housing and the lighting mount. Preferably, the first coupling member is attached to or associated with or configured for attachment to the housing for a lighting apparatus.

In another aspect of the invention is a light fitting (which optionally may have any coupling mechanism to facilitate its mounting to a substrate or support) and in a further aspect and preferred embodiment there is a light fitting comprising a coupling mechanism as defined above. In another aspect, there is provided a housing. These are described below and may or need not include the coupling mechanism as discussed above. The lighting mechanism and housing are described below and are considered to be disclosed either in combination or not in combination with the coupling mechanism described above or, preferably (where the context allows) both with and without the coupling mechanism.

A lighting system of the invention comprises a housing for housing light source and/or directing a beam of light from a light source and a lighting mount for securing the lighting apparatus to a support or substrate.

A substrate may be for example a plaster board or brick wall or a lathe and plaster wall or a ceiling, or the like. A support may comprise a mounting rod, a cable, a suspended rod system or the like.

In an aspect and embodiment of the lighting system in which it is provided with a coupling mechanism (e.g. a coupling mechanism as described above), the lighting apparatus further comprises a first coupling member comprising a curved strip and a second coupling member comprising a retaining element for coupling with the curved strip. The second coupling member may couple with the first coupling member at multiple positions along a length of the curved strip and wherein the first and second coupling members are configured for magnetic coupling, whereby the first coupling member and the second coupling member may be adjustably orientated relative to one another about at least one axis.

Preferably, the first coupling member is attached to one of the housing the lighting mount and the second coupling member is attached to the other of the housing and the lighting mount and more preferably, the first coupling member is attached to the housing. The coupling may be further defined as above.

In a preferred embodiment, the housing comprises at least a curved outer surface portion and wherein the curvature of the outer surface portion and the curved strip are substantially similar (e.g. having radii of curvature within 30% of one another, more preferably within 20% of one another and still more preferably within 10% of one another and preferably the same). Preferably, the curved strip is disposed on, in or at the outer surface portion of the housing. In one embodiment, the curved strip is located beneath or within the surface of the housing but in such a position that enables coupling with the retaining element to be effectively achieved. In another embodiment, the curved strip is disposed on the housing, e.g. on an outside surface of the housing and defining a raised profile relative to the housing. It may be fixed thereon by any suitable means, including but not limited to adhesives and other chemical or mechanical retention means. In another, preferred, embodiment, the curved strip is disposed in relation to the housing to be flush with the surface of the housing.

The housing may be formed of any suitable material for its purpose. It may comprise magnets or ferromagnetic material, but preferably is primarily formed of a non-ferromagnetic material. The housing may comprise metal and/or plastic. For example, it may comprises of aluminum and/or plastic. Thus, it is preferable that the curved strip is distinct or distinguished from the housing on or in which it is disposed by the relative ferromagnetic natural of the materials and preferably by being ferromagnetic whilst the housing material is non-ferromagnetic. Preferably, the housing is formed of aluminum By the provision of the curved strip on or in the housing, the housing for coupling or cooperating with a retaining element of a second coupling member associated with a mount or substrate, the angle of orientation of the housing (and thus the angle of a light beam) may be adjusted through an angled defined by the curvature and length of the curved strip, e.g. through up to 270° and preferably through at least 90°, more preferably in the range 110 to 235°, for example from 120 to 140°. By providing a curved strip on the housing that facilitates angle adjustment along its length of a particular angle, such as 120 to 140°, the arrangement can be enabled according to the choice of location of the curved strip (e.g. from close to a mouth of the housing to bisect a longitudinal plane of the housing) to facilitate effective angle adjustment of double that amount, e.g. from 240 to 280°, by virtue of a the rotation of the housing about a second axis according to the configuration of the first and second coupling member or the second coupling member.

Accordingly, the housing is preferably adjustable in angle relative to the mount about a first axis transverse to a longitudinal axis of the curved strip by coupling the curved strip to the retaining element at multiple positions along the length of the curved strip. The housing preferably is adjustable in angle relative to the mount about the first axis by at least 90°, preferably at least 120°.

Preferably, as mentioned, the housing is adjustable in angle relative to the mount about a second axis, the second axis being perpendicular to a facing coupling surface of the retaining element.

Preferable, the housing comprises a light beam channel for the passage of light from a light source through the housing to a mouth. Preferably the light beam channel defines a horizontal axis of the housing, through which any longitudinal planes pass. Preferably, the light beam channel is defined by an internal surface of the housing.

The housing may be defined as having a front portion being that portion centred about and proximal to the mouth and a back portion being that portion distal from the mouth.

In one embodiment, body comprises a heat sink zone comprising a heat sink. This may be configured to provide ventilation and cooling to the housing. Preferably, a heat sink zone is disposed in a back portion of the housing, such as a back half and optionally a back third of the housing.

Heat generated in the housing by the light unit may typically be removed by convective air movement. As the light unit heats, warm air moves upwards through the ventilation openings which are preferentially located on the back half of the housing to enable maximum convective air flow. The heat sink preferably comprises ventilation openings that may be grooved and of sufficient size to enable maximum convective air flow.

Preferably, the heat sink comprises a plurality of substantially parallel fins. Preferably, there are at least four fins, optionally up to ten, e.g. six to eight. The fins are preferably formed of aluminum.

In a particularly preferred embodiment, the curved strip is disposed on or in the housing so that it extends into, through or over the heat sink zone and wherein a longitudinal axis of the curved strip is substantially parallel with the parallel fins. By this arrangement, the fins of the heat sink may always be orientated such that there is an upward opening of the vents to ensure adequate cooling.

Preferably, the housing is shaped so that it has an expanded waist portion (e.g. between the front and pack portions). Preferably, the housing is at least partially spherical, preferably a truncated sphere, the truncated sphere generally comprising as sphere truncated at the mouth of the light beam channel.

In one embodiment, in which the curved strip is disposed in, on or at a curved surface of the housing, the curved strip comprises two elongate members separated by a recess, whereby a power and/or data cable may be disposed through the recess.

Preferably, the retaining element comprises a magnetic ring disposed in a ring shaped housing thereby defining an aperture through which a power and/or data cable may be disposed in cooperation with a recess in the curved strip.

In one generally preferred embodiment, the housing comprises a housing body and a peripheral insert, wherein the peripheral insert defines at least a portion of the light beam channel.

Reference is made to light fittings and components thereof in terms of their position and in particular to interior and exterior (e.g. surfaces of bodies) and inner and outer (e.g. location of components in a light fitting). By interior and exterior it is meant inside or on the inside surface of a respective defined body or outside or on the outside surface of a respective defined body. The terms interior and exterior will typically relate to lateral variations (e.g. laterally outside the body), being lateral to the beam from a luminaire or, for a light fitting which has a longitudinal axis corresponding to its ordinary luminaire beam direction, lateral to the longitudinal axis. The terms inner and outer are used, generally, to refer to a position along the light beam channel, for example, such as along the longitudinal axis thereof, such that an inner location or inner direction is considered to be toward the light source whilst an outer location or outer direction is considered to be away from the luminaire or light source or in other words in the direction of the light beam.

The peripheral insert may be of any suitable shape. It should preferably have an external surface shape to generally cooperate with a housing body into which it is inserted and an internal surface shape according to the desired shape of the light beam channel which the peripheral insert forms.

The insert is preferably removably mountable within the housing body. Thus, an insert may be substituted or changed, for example to facilitate a different optical effect (e.g. a reflective internal surface as opposed to a matt surface) or textured effect, or simply a different finish (e.g. a white finish as opposed to a black finish). The insert may also have a defined internal surface shape whereby the insert may be substituted to provide different internal surface shapes.

Preferably, in any case, the peripheral insert is an annular insert for being disposed in relation to a cylindrical internal surface of a housing body. The peripheral insert may be referred to as peripheral or annular but features thereof are considered to be generally applicable where the context allows.

It is preferred that the annular insert is removably mountable within the housing body. The annular insert may be mounted or fitted by any suitable means, e.g. a slide or friction fit or a snap fit. Preferably, the annular insert is removably mountable within the housing body by way of cooperating threads on an external surface of the annular insert and an internal surface of the housing body.

The annular insert may be disposed at any location within the light beam channel and cooperate with an internal surface of the housing at any location therein so as to define any portion of the light beam channel. For example, the insert and housing may be configured for disposal of the insert deep within the housing/light beam channel (distal to the mouth), e.g. toward a throat portion, or at a shallow position (proximal to the mouth) or in between. The annular insert may extend longitudinally by a more or less amount as desired. For example, the peripheral insert may define from 5% to 100% of the extent of the internal surface of the channel. It may extend a major portion of the length of the channel in which it is disposed (and the surface of which it may partially form), such as from 60 to 90% of the length or 70 to 80%, or a minor portion of the length, such as from 15 to 40% of the length or 20 to 30%. Preferably, however, it extends by at least 75% of the length of the channel, still more preferably at least 85% and most preferably at least 90%.

In a preferred embodiment, the light fitting comprises an optical mount for an optical element, such as a lens, the optical mount preferably being formed to allow the optical element to be disposed within the light beam channel (e.g. in a throat thereof) of the housing body. Preferably, the optical mount comprises a seat for supporting an optical element and a corresponding recess for receiving an optical element. Preferably, the optical element (e.g. lens) is removably mountable in the optical mount of the housing.

Preferably, the peripheral insert serves to retain the optical element in position in the optical mount, whereby the optical element may be removed by first removing the peripheral insert from the housing body.

The optical element or lens may be fixed within the housing at the mount, but is preferably removable, so that a lens of a different effect can be inserted in place thus allowing for considerable adaptability of the luminaire support. Preferably, the lens is removable via the mouth of the housing.

Preferably, according to this general embodiment, an LED is disposed within the light beam channel within the housing at an LED mount.

In a preferred embodiment, the annular insert is disposed so as to extend toward the inner portion of the light beam channel from the mouth and, in particular, from the rim of the mouth. Preferably, the annular insert is configured to cooperate with the housing body to form an edge or rim together with the housing body defining a rim of the mouth. Preferably, a neat fit is achieved whereby, at or near (e.g. within 2 mm of) the rim, the housing body and annular insert are separated by no more than 2 mm, more preferably no more than 1 mm, still more preferably no more than 0.5 mm and still more preferably no more than 0.2 mm. Alternatively, the annular insert comprises a flange or lip which extends laterally from one end of the annular insert and is configured to extend over or engage a rim of the housing body, e.g. a flange or lip having a lateral extent of up to 2 mm, more preferably, up to 1 mm and optionally from 0.2 to 0.8 mm.

In a preferred embodiment, the annular insert is generally tubular in shape. The annular insert preferably has a cooperating means at an end thereof distal to the mouth, as defined in situ, for cooperating with a tool for inserting or removing the insert.

Preferably, the annular insert extends from the mouth of the luminaire support to the optical mount, or substantially to the optical mount (e.g. separated by an amount to allow a recess for receiving an annular flange of an optical element, such as up to 5 mm, preferably from 1 to 3 mm) or, where an optical element is in position, to an optical element. According to this preferred embodiment, the annular insert may define the light beam channel from the lens to the mouth.

In one embodiment, the peripheral insert comprises engaging features for facilitating or enabling cooperative inter-engagement with a corresponding engaging means of a manipulating tool or with another optical component (which for example, may be attachable or insertable into the housing body via the mouth). The engaging features may be recesses or protrusions.

In one embodiment, the peripheral insert defines an engaging recess for receiving a protrusion in a cooperating tool or other optical component. Preferably, the engaging recess, and more preferably at least two engaging recesses are provided to enable a user to engage a tool into the recesses so as to remove the insert from the housing body, for example by pulling it out (in the case of a snap or friction fit) or by twisting and unthreading (in the cases of a cooperating threaded fit). The recesses may be defined entirely within the body of the insert so as to form two or more apertures for receiving an engaging element (either from a cooperating tool or other optical component). The apertures may be disposed at any position along the length of the insert as may be desired but are preferably provided in a distal portion relative to the mouth of the housing, so as to minimize visual impact, preferably in the distal third of the insert, more preferably the distal quarter of the insert and still more preferably in the distal 10% of the insert. Optionally, as an alternative to apertures, the engaging recesses in the insert may be formed by notches formed in a distal edge of the insert.

Preferably, engaging recesses have an elongate extent or length that is circumferential (e.g. perpendicular to a longitudinal axis of the light beam channel). Preferably, the width may be up to 10 mm, preferably up to 7 mm, e.g. at least 1 mm and preferably from 2.5 to 5 mm. The length of the engaging recesses may preferably be at least 3 mm, e.g. from 5 mm to 10 mm or longer and preferably the engaging recesses are circumferentially separated from one another by at least 2 mm, more preferably at least 5 mm and still more preferably at least 10 mm. There may be any number of engaging recesses as may be required for different functions or for a single function. Preferably there are two engaging recesses disposed radially opposing one another on an annular insert.

The light fitting optionally comprises an optical accessory. The optical accessory may be any further accessory to a light fitting that affects the light beam, e.g. introduces a change to the nature of the light beam, such as its beam angle, wavelength range, incident pattern or the like. It may be, for example, a filter or a honeycomb device. Preferably, the optical accessory has a light adapting element (such as a honeycomb grid or honeycomb patterned transparent element) and an accessory body for supporting or housing the adapting element. In a preferred embodiment, the accessory body and indeed the optical accessory is adapted to removably attach to the housing via the mouth of the housing. Optionally, the optical accessory may be retained in place by way of the peripheral insert whereby the optical accessory may only be installed or removed by first removing the peripheral insert. Alternatively, and preferably, the optical accessory may be removably attached to the housing via the mouth when the peripheral insert is in place, i.e. through the mouth of the peripheral insert. In either case, the optical accessory may be adapted to attach to either or both (e.g. in a recess defined by both) of the peripheral insert and the housing body. Preferably, the optical accessory may be attached to the housing via engagement with the peripheral insert, such as via engaging features on or associated with the insert, which are preferably recesses or apertures defined therein and preferably these are releasably engaged (e.g. by push-pull fit arrangement) with resilient laterally or outwardly extending tabs disposed on the accessory body. The accessory body is preferably configured to slot into the light beam channel and the peripheral insert. Preferably, the accessory body is generally tubular and defines an accessory longitudinal axis, which when the optical accessory is disposed in a housing with the peripheral insert is generally coaxial with the peripheral insert and the light beam channel. The optical accessory may be configured so that the adapting element is disposed inside the light beam channel or extends out of the light beam channel (e.g. out of the mouth) or is disposed outside the light beam channel, but preferably is disposed within the light beam channel. If disposed in the light beam channel, the optical accessory may be configured to provide the adapting element at the mouth of the luminaire support (e.g. flush with the rim of the mouth) or at an inner position (at a depth) within the light beam channel, such as relatively closer to a lens (or the throat of the housing body), such as adjacent thereto. In either case, the accessory body may have a tubular shape which extends from the mouth of the luminaire support into the light beam channel, which accessory body optionally has an internal surface which may define at least part of the light beam channel when in situ.

The invention will now be described in more detail, without limitation, with reference to the accompanying Figures.

Figure 2:
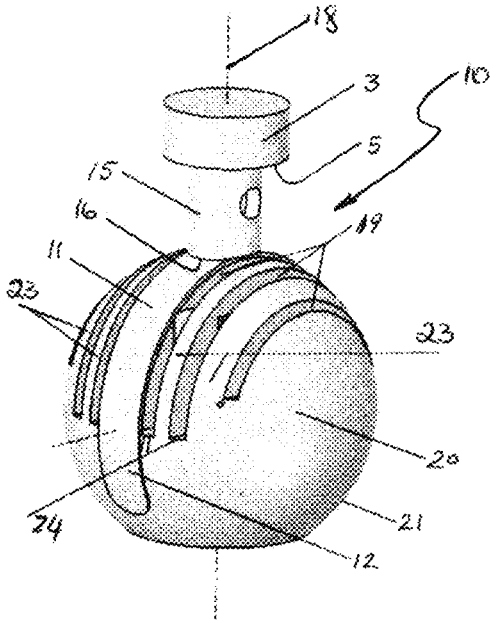
FIG. 2 is a perspective view of a lighting apparatus of FIG. 1 in a second configuration.
Figure 3:
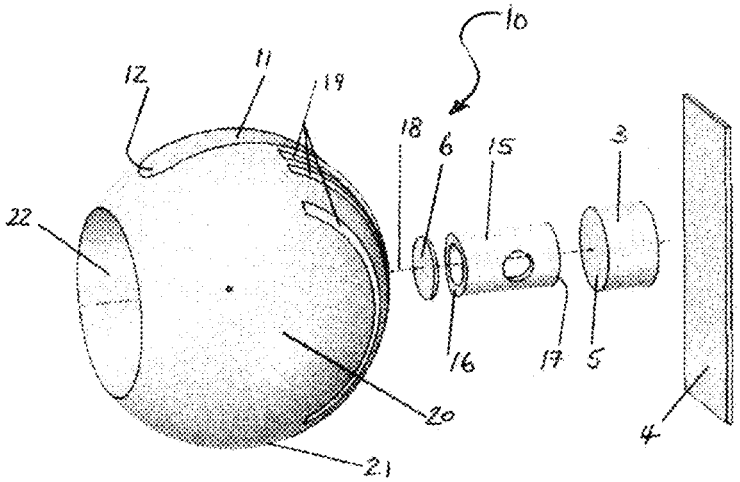
FIG. 3 is an exploded view of a further embodiment of a lighting apparatus of the invention.

FIGS. 1 to 3 illustrate a lighting apparatus according a first general embodiment.

In FIGS. 1 and 2, a lighting apparatus 1 comprises a housing 20 having curved spherical outer surface 21 and with a circular opening mouth 22, a cylindrical lighting mount 3 and a coupling mechanism 10 extending from the housing 20 to the lighting mount 3.

In FIGS. 2 and 3 a coupling mechanism 10 has two coupling members 11, 15. The first member is shown as a curved strip 11 attached to the housing 20 so that the curved surface 12 of the curved strip 11 is flush with the outer surface of the housing 21. The curved strip 11 is attached to the housing in a plane that passes through the centre axis of the circular opening 22. Ventilation openings 19 allow air movement from the inside to the outside of the housing 20 and are provided as substantially parallel slotted openings 19 on either side of part of curved strip 11 with ends 24 aligned in a plane parallel to circular opening 22. The slotted openings 19 are defined by fins 23, which form part of the housing 20 and which provide additional housing surface area for heat loss from within housing 20. A second coupling member is shown as a cylindrical retaining element 15, with one circular facing coupling surface 16 of the cylindrical retaining element 15 being magnetically coupled to the curved surface 12 of the curved strip 11 and the second circular end face 17 being coupled to the free end face 5 of lighting mount 3.

In the embodiment of FIGS. 1 and 2, the cylindrical retaining element 15 is comprised of a magnet and the curved strip 11 and lighting mount 3 contain ferromagnetic steel. The two coupling members 11 and 15 are shown in a magnetically coupled position in FIG. 1 and FIG. 2 and remain coupled when curved strip 11 is directed past the retaining element facing coupling surface 16 so that different coupling positions are achieved along the length of the curved strip 11. Different coupling positions on the curved strip create a different position of the circular opening 22 in relation to the lighting mount 3 so that when light is transmitted from a light source inside the housing via the circular opening 22 the light is directed to a different angle of illumination. FIGS. 1 and 2 illustrate different coupling positions and show the circular opening 22 being coupled at different angles with respect to lighting mount 3 and coupling axis 18. The magnetic coupling members 11 and 15 are also free to rotate about magnetic coupling axis 18 while remaining magnetically coupled so that light transmitted via the circular opening 22 may also be adjusted to a different rotational angular position about coupling axis 18.

FIG. 3 shows an alternative embodiment as an exploded view of the lighting apparatus 1 in which the coupling mechanism 10 is shown with two coupling members 11, 15. Curved strip 11 and lighting mount 3 are made from ferromagnetic steel and the cylindrical retaining element 15 is a magnet, with one circular facing coupling surface 16 of the retaining element 15 having a cover of resilient material 6. Lighting mount 3 is attached to support 4 by means of a screw not shown.

When assembled the magnetic coupling members 11 and 15 are free to rotate about a magnetic coupling axis 18 and remain coupled as curved strip 11 is moved through the magnetic field of retaining element 15 so that different coupling positions can be achieved along the length of curved strip 11. Different coupling positions on the curved strip 11 and different rotational coupling positions around axis 18 create different positions of the circular opening 22 in relation to the lighting mount 3 and support 4, so that when light is transmitted from a light source via the circular opening 22 the light can be directed easily to different illumination areas.

Figure 4:
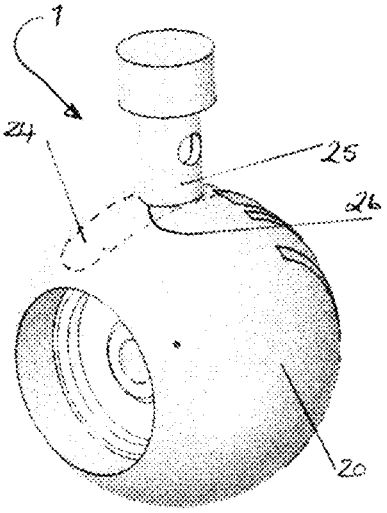
FIG. 4 is a perspective view of a further embodiment of a lighting apparatus of the invention.

FIG. 4 shows a second general embodiment where the curved strip 24 is embedded in the housing 20 of the lighting apparatus 1. Different positions of magnetic coupling of the embedded ferromagnetic curved strip 24 to retaining element magnet 25 is achieved when the area of the housing 20 with embedded curved strip 24 is directed past the facing surface 26 of magnet retaining element 25.

Figure 5:
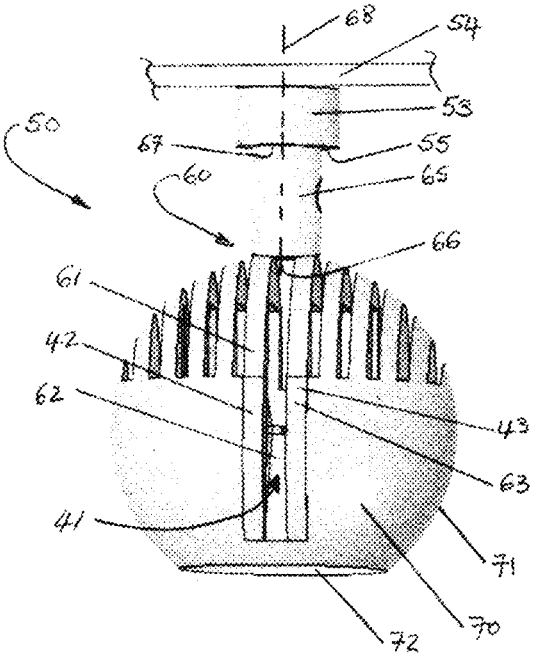
FIG. 5 is an end view of a further embodiment of a lighting apparatus of the invention.

FIG. 5 illustrates a lighting apparatus 50 according to a third general embodiment in which the lighting apparatus comprises a housing 70 having curved spherical outer surface 71 and with a circular opening mouth 72, a cylindrical lighting mount 53 attached to a support 54 and a coupling mechanism 60 extending from the housing 70 to the lighting mount 53.

In FIG. 5 the coupling mechanism 60 is shown with coupling members 61, 63, 65. The first coupling member 41 is shown as 2 curved strips 61, 63 attached to the housing 70 so that the curved surfaces 42, 43 of the curved strips 61, 63 are flush with the outer surface of the housing 71 and are separated by space 62. The first coupling member 41 is attached to the housing in a plane that passes through the centre axis of the circular mouth opening 72. A second coupling member is shown as a cylindrical retaining element 65, with one circular end face 66 of the cylinder being coupled to the curved surface 42, 43 of the curved strips 61, 63 and the second circular end face 67 being coupled to the free circular end face 55 of lighting mount 53.

In the embodiment of FIG. 5 the cylindrical retaining element 65 is comprised of a magnet, the curved strips 42, 43 and lighting mount 53 comprise ferromagnetic steel and the space 62 is an air gap. The two coupling members 41 and 65 are shown in a magnetically coupled position in FIG. 5 and remain coupled when curved strips 42, 43 are directed past the retaining element end face 66 so that different coupling positions are created anywhere along the length of the curved strips 62, 63. Different coupling positions on the curved strips 62, 63 create a different position of the circular opening 72 in relation to the lighting mount 53 and support 54 and axis 68 so that when light is transmitted from a light source within the housing via the circular opening 72 the light is directed to a different angle of illumination.

The magnetic coupling members 41 and 65 are free to rotate about a magnetic coupling axis 68 so that light transmitted via the circular opening 72 may also be adjusted to a different rotational angular position about coupling axis 68.

Figure 6:
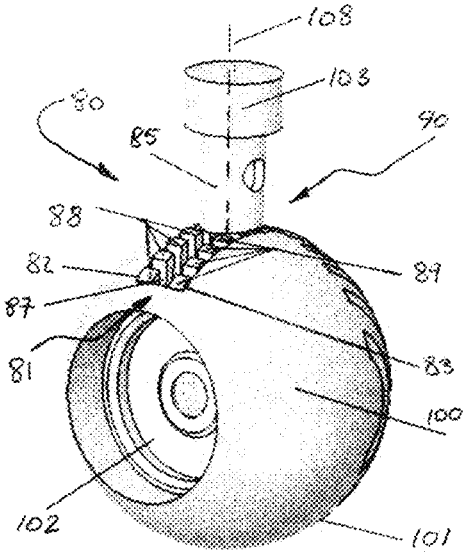
FIG. 6 is a perspective view of a further embodiment of a lighting apparatus of the invention.

FIG. 6 illustrates a lighting apparatus 80 according to a fourth general embodiment in which the coupling mechanism 90 is shown with coupling members 81, 85. A first coupling member 81 is shown as several ferromagnetic steel elements 88, 89 formed generally into the outline shape of a curved strip, separated by a space 87 and attached to the housing 100 so that the surfaces 82, 83 are substantially flush with the outer surface 101 of the housing 100. The first coupling member 81 is attached to the housing 100 in a plane that passes through the centre axis of the circular opening 102. The second coupling member 85 is a cylindrical magnet and is magnetically coupled to the ferromagnetic elements 88, 89 and also to ferromagnetic lighting mount 103.

The two coupling members 81 and 85 are shown in a magnetically coupled state and remain coupled when ferromagnetic elements 88, 89 are directed past second coupling member 85 so that different coupling positions are created anywhere along the length of the first coupling member 81. Different coupling positions create a different position of the circular opening 102 in relation to the lighting mount 103 and axis 108 so that when light is transmitted from a light source via the circular opening 102 the light is directed to a different angle of illumination.

The magnetic coupling members 81 and 85 are free to rotate about a magnetic coupling axis 108 so that light transmitted via the circular opening 102 may be adjusted to a different rotational angular position about axis 108.

Figure 7:
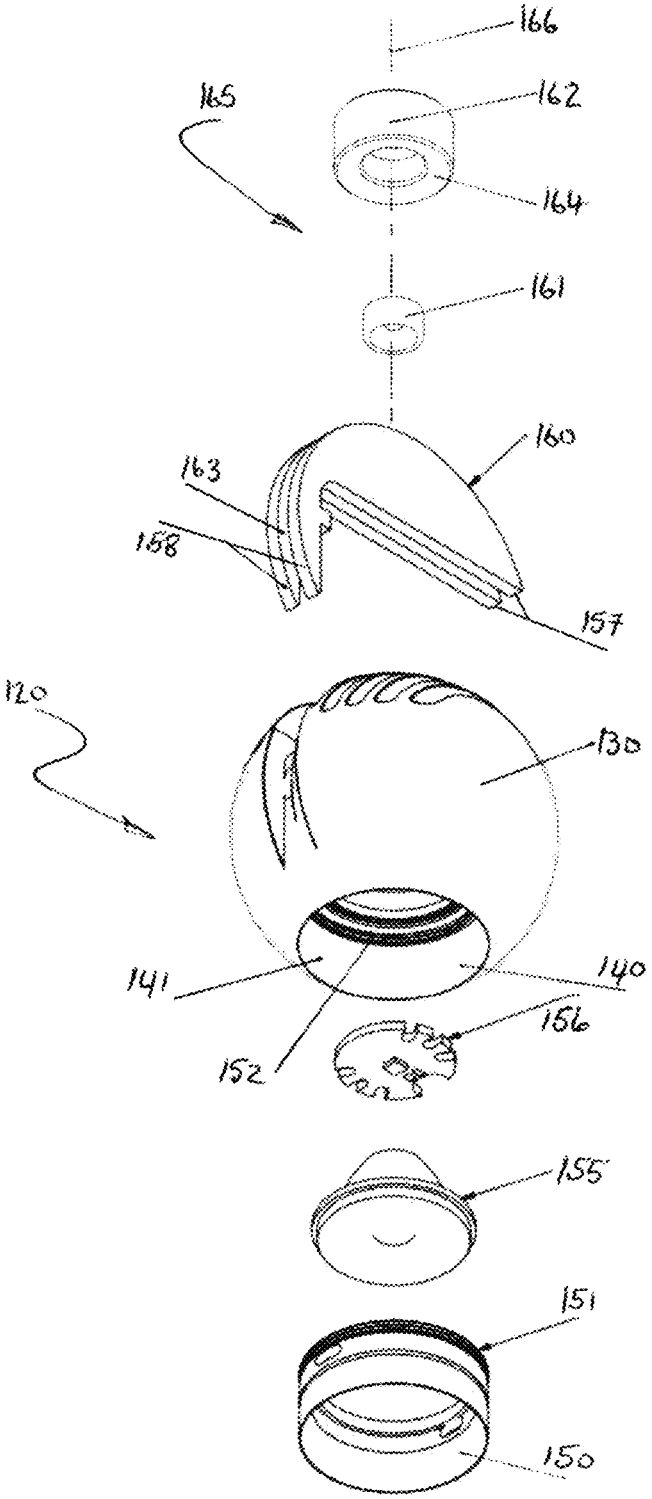
FIG. 7 is a perspective exploded view of a still further embodiment of a lighting apparatus of the invention.

FIG. 7 is an exploded view of a fifth general embodiment with a lighting apparatus 120 in which the housing 130 has a light beam channel 140 with a circular channel opening 141. A threaded peripheral ring insert 150 is mounted in the light beam channel 140 by means of a threaded interface 151, 152 with the housing 130. The threaded peripheral insert 150 locates an optical lens element 155 in the light beam channel 140. Light emanating from the LED light source 156 is transmitted from housing 130 by way of the optical lens element 155, threaded peripheral ring insert 150, light beam channel 140 and the light beam channel opening 141.

In this embodiment a first coupling member 160 is shown being of two ferromagnetic steel plate members 157 having plate edges 158 which define a curved strip. A second coupling member 165 is a hollow magnet 161 encased in magnet holder 162 with curved surface 164 which once assembled as a light fitting is magnetically coupled with first coupling member 160. An electrical cable (not shown) for providing electrical power to the LED light source 156 passes through gap 163 between the plate members 157 and the centre of the magnet 161 and magnet holder 162. For the purpose of retaining the lighting apparatus 120 to a fixed support, magnet holder 162 is coupled or attached to a fixed support mounting (not shown). Adjustment of the illuminating light transmitted by way of the channel opening 141 is achieved by moving the light housing 130 so that different coupling positions are achieved on first coupling member 160. Coupling members 160 and 165 are also free to rotate about coupling axis 166 to enable light transmitted by way of channel opening 141 to be adjusted to a different rotational angular position about axis 166.

Figure 8:
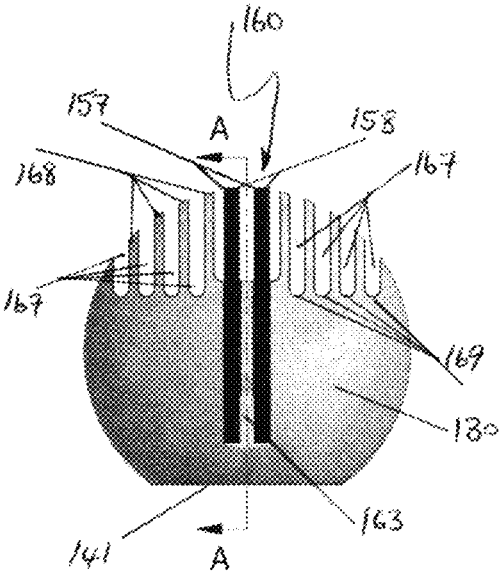
FIG. 8 is an end view of a housing for a lighting apparatus of the embodiment shown in FIG. 7.

FIG. 8 shows an assembled view of light housing 130 of the fifth embodiment having first coupling member 160, ferromagnetic steel plate members 157 separated by gap 163 and with plate edges 158. Parallel slotted ventilation grooves 167 allowing air movement from the inside to the outside of housing 130 are shown on both sides of part of first coupling member 160 positioned substantially parallel to ferromagnetic steel plate members 157 and having ends 169 aligned in a plane parallel to channel opening 141. The ventilation grooves 167 define housing material heat transfer fins 168 which further aid heat transfer from within housing 130.

Figure 9:
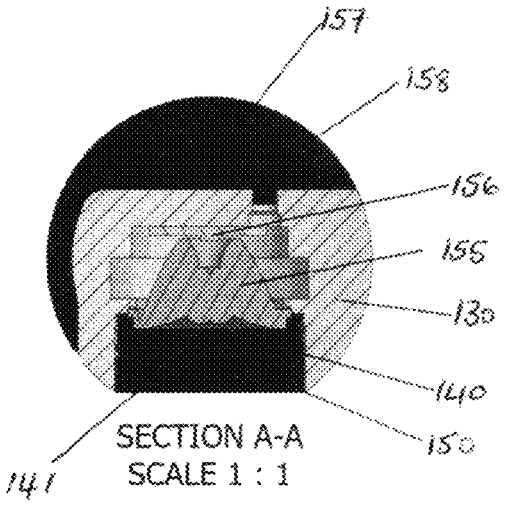
FIG. 9 is a cross-sectional view of the housing of FIG. 8.

FIG. 9 shows a sectional view on Section A-A of FIG. 8. Ferromagnetic steel plate member 157 has curved plate edge 158 forming part of the first coupling member curved strip 160 fixedly located within housing 130. Threaded peripheral ring insert 150 is mounted in the light beam channel 140 by means of a threaded interface with housing 130. The threaded peripheral insert 150 locates an optical lens element 155 in the light beam channel 140. Light emanating from the LED light source 156 is transmitted by way of the optical lens element 155, threaded peripheral ring insert 150, light beam channel 140 and the light beam channel opening 141.

The invention has been described with reference to a preferred embodiment. However, it will be appreciated that variations and modifications can be effected by a person of ordinary skill in the art without departing from the scope of the invention.

The invention claimed is:

1. A coupling mechanism for a lighting apparatus, the coupling mechanism comprising:

a first coupling member comprising a curved strip; and a second coupling member comprising a retaining element for coupling with the curved strip;

wherein the second coupling member may couple with the first coupling member at multiple positions along a length of the curved strip and wherein the first and second coupling members are configured for magnetic coupling, whereby the first coupling member and the second coupling member may be adjustably orientated relative to one another about at least one axis, wherein the first coupling member is attached to or associated with or configured for attachment to a housing for a lighting apparatus and the second coupling member is attached to or associated with or configured for attachment to a lighting mount.

2. The coupling mechanism according to claim 1, wherein the first coupling member and second coupling member are configured to be adjustably orientated relative to one another about two axes.

3. The coupling mechanism according to claim 1, wherein the curved strip is curved about an axis perpendicular or transverse to a longitudinal axis of the curved strip.

4. The coupling mechanism according to claim 1, wherein the first and second coupling members are configured for magnetic coupling at any position along the length of the curved strip.

5. The coupling mechanism according to claim 1, wherein the curved strip comprises two elongate elements or rails separated by a recess.

6. The coupling mechanism according to claim 1, wherein the first coupling member comprises one or a plurality of plate members having a plate edge, which one or more plate edges define the curved strip.

7. The coupling mechanism according to claim 1, wherein the retaining element is a ring-shaped or partial ring-shaped member.

8. The coupling mechanism according to claim 1, wherein the retaining element is disposed in a recess of a retaining housing.

9. The coupling mechanism according to claim 1, wherein the curved strip and the retaining element are configured to be adjustably orientated relative to one another about two axes.

10. The coupling mechanism according to claim 9, wherein a first of the two axes is an axis transverse to a longitudinal axis of the curved strip.

11. The coupling mechanism according to claim 9, wherein the retaining element comprises a facing coupling surface, being that surface facing a coupling location on the curved strip when disposed in a coupled configuration with the curved strip and a second of the two axes is perpendicular to the facing coupling surface of the retaining element.

12. The coupling mechanism according to claim 1, wherein the retaining element comprises a magnet while the curved strip comprises a ferromagnetic material.

13. The coupling mechanism according to claim 12, wherein the curved strip comprises mild steel.

14. A lighting apparatus comprising:

a housing for housing a light source and/or directing a beam of light from a light source;

a lighting mount for securing the lighting apparatus to a support or substrate; and a coupling mechanism comprising:

a first coupling member comprising a curved strip; and a second coupling member comprising a retaining element for coupling with the curved strip;

wherein the second coupling member may couple with the first coupling member at multiple positions along a length of the curved strip and wherein the first and second coupling members are configured for magnetic coupling, whereby the first coupling member and the second coupling member may be adjustably orientated relative to one another about at least one axis, wherein the first coupling member is attached to the housing and the second coupling member is attached to the lighting mount.

15. The apparatus according to claim 14, wherein the housing comprises at least a curved outer surface portion and wherein the curvature of the outer surface portion and the curved strip are substantially similar and wherein the curved strip is disposed on, in or at the outer surface portion of the housing.

16. The apparatus according to claim 14, wherein the housing is adjustable in angle relative to the mount about a first axis transverse to a longitudinal axis of the curved strip by coupling the curved strip to the retaining element at multiple positions along the length of the curved strip.

17. The apparatus according to claim 16, wherein the housing is adjustable in angle relative to the mount about the first axis by at least 90°.

18. The apparatus according to claim 14, wherein the housing is adjustable in angle relative to the mount about a second axis, the second axis being perpendicular to a facing coupling surface of the retaining element.

19. The apparatus according to claim 14, wherein the housing comprises a light beam channel for the passage of light from a light source through the housing to a mouth, the light beam channel defined by an internal surface of the housing, wherein the housing comprises a housing body and a peripheral insert, wherein the peripheral insert defines at least a portion of the light beam channel and wherein the peripheral insert is removably mountable within the housing body.

20. The apparatus according to claim 19, which comprises an optical mount for an optical element, the optical mount being disposed within the light beam channel of the housing body, wherein the optical element is removably mountable in the optical mount and the peripheral insert serves to retain the optical element in position in the optical mount, whereby the optical element may be removed by first removing the peripheral insert from the housing body.

21. The apparatus according to claim 14, wherein the housing comprises a heat sink zone comprising a heat sink, which comprises a plurality of substantially parallel fins.

22. The apparatus according to claim 21, wherein the curved strip is disposed within the heat sink zone and wherein a longitudinal axis of the curved strip is substantially parallel with the parallel fins.

23. The apparatus according to claim 14, wherein the housing is at least partially spherical, wherein the curved strip is disposed in, on or at a curved surface of the housing and wherein the curved strip comprises two elongate members separated by a recess, whereby a power and/or data cable may be disposed through the recess.

24. The apparatus according to claim 14, wherein the housing is for housing a light source and directing a beam of light from a light source, wherein the beam of light is adjustable in angle relative to the mount about a first axis transverse to a longitudinal axis of the curved strip by coupling the curved strip to the retaining element at multiple positions along the length of the curved strip, and wherein the beam of light is adjustable in angle relative to the mount about a second axis, the second axis being perpendicular to a facing coupling surface of the retaining element.

* * * * *